US007840410B2

(12) United States Patent
Fellers et al.

(10) Patent No.: US 7,840,410 B2
(45) Date of Patent: Nov. 23, 2010

(54) AUDIO CODING BASED ON BLOCK GROUPING

(75) Inventors: Matthew Conrad Fellers, San Francisco, CA (US); Mark Stuart Vinton, San Francisco, CA (US); Claus Bauer, San Francisco, CA (US); Grant Allen Davidson, Burlingame, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1132 days.

(21) Appl. No.: 10/586,834

(22) PCT Filed: Jan. 19, 2005

(86) PCT No.: PCT/US2005/001715

§ 371 (c)(1),
(2), (4) Date: Jul. 19, 2006

(87) PCT Pub. No.: WO2005/071667

PCT Pub. Date: Apr. 8, 2005

(65) Prior Publication Data

US 2008/0133246 A1 Jun. 5, 2008

Related U.S. Application Data

(60) Provisional application No. 60/537,984, filed on Jan. 20, 2004.

(51) Int. Cl.
*G10L 19/00* (2006.01)
*G10L 21/00* (2006.01)

(52) U.S. Cl. ..... 704/500; 704/501; 704/503

(58) Field of Classification Search ..... 704/500–504, 704/200.1

See application file for complete search history.

(56) References Cited

U.S. PATENT DOCUMENTS

| | | | | |
|---|---|---|---|---|
| 5,109,417 | A * | 4/1992 | Fielder et al. | 704/205 |
| 5,311,561 | A | 5/1994 | Akagiri | |
| 6,167,375 | A * | 12/2000 | Miseki et al. | 704/229 |
| 6,300,888 | B1 * | 10/2001 | Chen et al. | 341/63 |
| 6,424,939 | B1 * | 7/2002 | Herre et al. | 704/219 |
| 6,456,963 | B1 | 9/2002 | Araki | |
| 7,283,968 | B2 * | 10/2007 | Youn | 704/500 |
| 2003/0088423 | A1 * | 5/2003 | Nishio et al. | 704/500 |
| 2003/0187634 | A1 * | 10/2003 | Li | 704/200.1 |
| 2003/0215013 | A1 * | 11/2003 | Budnikov | 375/240.16 |

OTHER PUBLICATIONS

Davidson, "Digital Audio Coding: Doby AC-3", in Digital Signal Processing Handbook, Ed. by Madisetti et al., CRC Press, 1999.*

(Continued)

*Primary Examiner*—Vijay B Chawan
*Assistant Examiner*—Jialong He

(57) ABSTRACT

Blocks of audio information are arranged in groups that share encoding control parameters to reduce the amount of side information needed to convey the control parameters in an encoded signal. The configuration of groups that reduces the distortion of the encoded audio information may be determined by any of several techniques that search for an optimal or near optimal solution. The techniques include an exhaustive search, a fast optimal search and a greed merge, which allow the search technique to tradeoff the reduction in distortion against the bit rate of the encoded signal and/or the computational complexity of the search technique.

36 Claims, 4 Drawing Sheets

OTHER PUBLICATIONS

Domazet, "Advanced software implementation of MPEG-4 AAC audio encoder", 4th EURASIP Conferecne, Jul. 2003.*

Absar , et al. "Development of AC-3 Digital Audio Encoder" AES 4821 (M-3), AES 105th Convention, San Francisco, California, Sep. 26-29, 1998.

Aggarwal, A., "Towards Weighted Mean-Squared Error Optimality of Scalable Audio Coding," PhD. Dissertation, University of California, Sta. Barbara, Dec. 2002.

Liu, et al., Design of MPEG-4 AAC Encoder,: AES 6201, AES 117th Convention, San Francisco, CA Oct. 28-31, 2004.

Prandoni, et al., "Optimal Time Segmentation For Signal Modeling and Compression," IEEE, 1997, pp. 2029-2032, [0-8186-7919-0/97].

Yang et al., "Cascaded Trellis-Based Optimization for MPEG-4 Advanced Audio Coding," AES 5977,AES 115$^{th}$ Convention, New York, Oct. 10-13, 2003.

* cited by examiner

AUDIO CODING BASED ON BLOCK GROUPING

TECHNICAL FIELD

The present invention relates to optimizing the operation of digital audio encoders of the type that apply an encoding process to one or more streams of audio information representing one or more channels of audio that are segmented into frames, each frame comprising one or more blocks of digital audio information. More particularly, the present invention relates to grouping blocks of audio information arranged in frames in such a way as to optimize a coding process that is applied to the frames.

BACKGROUND ART

Many audio processing systems operate by dividing streams of audio information into frames and further dividing the frames into blocks of sequential data representing a portion of the audio information in a particular time interval. Some type of signal processing is applied to each block in the stream. Two examples of audio processing systems that apply a perceptual encoding process to each block are systems that conform to the Advanced Audio Coder (AAC) standard, which is described in ISO/IEC 13818-7. "MPEG-2 advanced audio coding, AAC". International Standard, 1997; ISO/IEC JTCI/SC29, "Information technology—very low bitrate audio-visual coding," and ISO/IEC IS-14496 (Part 3, Audio), 1996, and so-called AC-3 systems that conform to the coding standard described in the Advanced Television Systems Committee (ATSC) A/52A document entitled "Revision A to Digital Audio Compression (AC-3) Standard" published Aug. 20, 2001.

One type of signal processing that is applied to blocks in many audio processing systems is a form of perceptual coding that performs an analysis of the audio information in the block to obtain a representation of its spectral components, estimates the perceptual masking effects of the spectral components, quantizes the spectral components in such a way that the resulting quantization noise is either inaudible or its audibility is as low as possible, and assembles a representation of the quantized spectral components into an encoded signal that may be transmitted or recorded. A set of control parameters that is needed to recover a block of audio information from the quantized spectral components is also assembled into the encoded signal.

The spectral analysis may be performed in a variety of ways but an analysis using a time-domain to frequency-domain transformation is common. Upon transformation of blocks of audio information into a frequency-domain representation, the spectral components of the audio information are represented by a sequence of vectors in which each vector represents the spectral components for a respective block. The elements of the vectors are frequency-domain coefficients and the index of each vector element corresponds to a particular frequency interval. The width of the frequency interval represented by each transform coefficient is either fixed or variable. The width of the frequency interval represented by transform coefficients generated by a Fourier-based transform such as the Discrete Fourier Transform (DFT) or a Discrete Cosine Transform (DCT) is fixed. The width of the frequency interval represented by transform coefficients generated by a wavelet or wavelet-packet transform is variable and typically grows larger with increasing frequency. For example, see A. Akansu, R. Haddad, "Multiresolution Signal Decomposition, Transforms, Subbands, Wavelets," Academic Press, San Diego, 1992.

One type of signal processing that may be used to recover a block of audio information from the perceptually encoded signal obtains a set of control parameters and a representation of quantized spectral components from the encoded signal and uses this set of parameters to derive spectral components for synthesis into a block of audio information. The synthesis is complementary to the analysis used to generate the encoded signal. A synthesis using a frequency-domain to time-domain transformation is common.

In many coding applications, the bandwidth or space that is available to transmit or record an encoded signal is limited and this limitation imposes severe constraints on the amount of data that may be used to represent the quantized spectral components. Data needed to convey sets of control parameters are an overhead that further reduces the amount of data that may be used to represent the quantized spectral components.

In some coding systems, one set of control parameters is used to encode each block of audio information. One known technique for reducing the overhead in these types of coding systems is to control the encoding processes in such a way that only one set of control parameters is needed to recover multiple blocks of audio information from an encoded signal. If the encoding process is controlled so that ten blocks share one set of control parameters, for example, the overhead for these parameters is reduced by ninety percent. Unfortunately, audio signals are not stationery and the efficiency of the encoding process for all blocks of audio information in a frame may not be optimum if the control parameters are shared by too many blocks. What is needed is a way to optimize the signal processing efficiency by controlling that processing to reduce the overhead needed to convey control parameters.

DISCLOSURE OF INVENTION

In accordance with the present invention, blocks of audio information arranged in frames are grouped into one or more sets or groups of blocks such that every block is in a respective group. Each group may consist of a single block or a set of two or more blocks within a frame and a process that is applied to each block in the group uses a common set of one or more control parameters such as, for example, a set of scale factors. The present invention is directed toward controlling the grouping of blocks to optimize signal processing performance.

In a coding system, for example, a stream of audio information comprising blocks of audio information is arranged in frames where each frame has one or more groups of blocks. A set of one or more encoding parameters is used to encode the audio information for all of the blocks within a respective group. The blocks are grouped to optimize some measure of encoding performance. For example, an encoding system that incorporates various aspects of the present invention may control the grouping of blocks to minimize a signal error that represents the distortion of the encoded audio information in a frame using shared encoding parameters for each group in the frame as compared to the distortion of an encoded signal for a reference signal in which each block is encoded using its own set of encoding parameters.

The various features of the present invention and its preferred embodiments may be better understood by referring to the following discussion and the accompanying drawings in which like reference numerals refer to like elements in the several figures. The contents of the following discussion and the drawings are set forth as examples only and should not be understood to represent limitations upon the scope of the present invention.

MODES FOR CARRYING OUT THE INVENTION

A. Introduction

Figure 1:
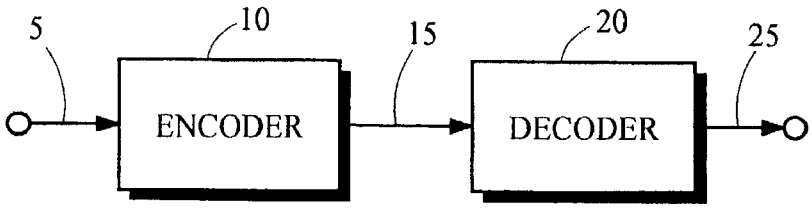
FIG. 1 is a block diagram of an audio coding system in which various aspects of the present invention may be incorporated.

FIG. 1 illustrates an audio coding system in which an encoder 10 receives from the path 5 one or more streams of audio information representing one or more channels of audio signals. The encoder 10 processes the streams of audio information to generate along the path 15 an encoded signal that may be transmitted or recorded. The encoded signal is subsequently received by the decoder 20, which processes the encoded signal to generate along the path 25 a replica of the audio information received from the path 5. The content of the replica may not be identical to the original audio information. If the encoder 10 uses a lossless encoding method to generate the encoded signal, the decoder 20 can in principle recover a replica that is identical to the original audio information streams. If the encoder 10 uses a lossy encoding technique such as perceptual coding, the content of the recovered replica generally is not identical to the content of the original stream but it may be perceptually indistinguishable from the original content.

The encoder 10 encodes the audio information in each block using an encoding process that is responsive to a set of one or more process control parameters. For example, the encoding process may transform the time-domain information in each block into frequency-domain transform coefficients, represent the transform coefficients in a floating-point form in which one or more floating-point mantissas are associated with a floating-point exponent, and use the floating-point exponents to control the scaling and quantization of the mantissas. This basic approach is used in many audio coding systems including the AC-3 and AAC systems mentioned above and it is discussed in greater detail in the following paragraphs. It should be understood, however, that scale factors and their use as control parameters is merely one example of how the teachings of the present invention may be applied.

In general, the value of each floating-point transform coefficient can be represented more accurately with a given number of bits if each coefficient mantissa is associated with its own exponent because it is more likely each mantissa can be normalized; however, it is possible an entire set of transform coefficients for a block may be represented more accurately with a given number of bits if some of the coefficient mantissas share an exponent. An increase in accuracy may be possible because the sharing reduces the number of bits needed to encode the exponents and allows a greater number of bits to be used for representing the mantissas with greater precision. Some of the mantissas may no longer be normalized but if the values of the transform coefficients are similar, the greater precision may result in a more accurate representation of at least some of the mantissas. The way in which exponents are shared among mantissas may be adapted from block to block or the sharing arrangement may be invariant. If the exponent sharing arrangement is invariant, it is common to share exponents in such a way that each exponent and its associated mantissas define a frequency subband that is commensurate with a critical band of the human auditory system. In this scheme, if the frequency interval represented by each transform coefficient is fixed, larger numbers of mantissas share an exponent for higher frequencies than they do for lower frequencies.

The concept of sharing floating-point exponents among mantissas within a block can be extended to sharing exponents among mantissas in two or more blocks. Exponent sharing reduces the number of bits needed to convey the exponents in an encoded signal so that additional bits are available to represent the mantissas with greater precision. Depending on the similarity of transform coefficient values in the blocks, inter-block exponent sharing may increase or decrease the accuracy with which the mantissas are represented.

The discussion thus far has referred to the tradeoff in the accuracy of a floating-point representation of transform coefficient values by sharing floating-point exponents. The same tradeoff in accuracy occurs for inter-block sharing of parameters used to control encoding processes such as perceptual coding that utilize perceptual models to control the quantization of the coefficient mantissas. The encoding processes used in AC-3 and AAC systems, for example, use the floating-point exponents of the transform coefficient to control bit allocation for quantization of transform coefficient mantissas. A sharing of exponents among blocks decreases the bits needed to represent the exponents, which allows more bits to be used to represent the encoded mantissas. In some instances, exponent sharing between two blocks decreases the accuracy with which the value of encoded mantissas are represented. In other instances, sharing between two blocks increases the accuracy. If a sharing of exponents between two blocks increases mantissa accuracy, a sharing among three or more blocks may provide further increases in accuracy.

Various aspects of the present invention may be implemented in an audio encoder by optimizing the number of groups and the group boundaries between groups of blocks to minimize encoded signal distortion. A tradeoff may be made between the degree of minimization and either or both of the total number of bits used to represent a frame of an encoded signal and the computational complexity of the technique used to optimize the group arrangements. In one implementation, this is accomplished by minimizing a measure of mean square error energy.

B. Background

The following discussion describes ways in which various aspects of the present invention may be incorporated into an audio coding system that optimizes the processing of groups of blocks of audio information arranged in frames. The optimization is first expressed as a numerical minimization problem. This numerical framework is used to develop several implementations that have different levels of computational complexity and provide different levels of optimization.

1. Group Selection as a Numerical Minimization Problem

Groups are allowed a degree of freedom in the optimization process by allowing a variable number of groups within frames. For the purpose of computing an optimal grouping configuration, it is assumed that the number of groups and the number of blocks in each group may vary from frame to frame. It is further assumed that a group consists of a single block or a multiplicity of blocks all within a single frame. The optimization to be performed is to optimize the grouping of blocks within a frame given one or more constraints. These constraints may vary from one application to another and may be expressed as a maximation of excellence in signal processing results such as encoded signal fidelity or they may be expressed as a minimization of an inverse processing result such as encoded signal distortion. For example, an audio coder may have a constraint that requires minimizing distortion for a given data rate of the encoded signal or that requires trading off the encoded signal data rate against the level of encoded signal distortion, whereas an analysis/detection/classification system may have a constraint that requires trading off accuracy of the analysis, detection or classification against computational complexity. Measures of signal distortion are discussed below but these are merely examples of a wide variety of quality measures that may be used. The techniques discussed below may be used with measures of signal processing excellence such as encoded signal fidelity, for example, by reversing comparisons and inverting references to relative amounts such as high and low or maxima and minima.

It is anticipated that the present invention may be implemented according to any one of at least three strategies that vary from one another in the use of time-domain and frequency-domain representations of audio information. In a first strategy, time-domain information is analyzed to optimize the processing of groups of blocks conveying time-domain information. In a second strategy, frequency-domain information is analyzed to optimize the processing of groups of blocks conveying time-domain information. In a third strategy, frequency-domain information is analyzed to optimize the processing of groups of blocks conveying frequency-domain information. Various implementations according to the third strategy are described below.

In practical implementations of the present invention for encoding audio information for transmission or recording, it is useful to define the terms "distortion" and "side cost" for the following discussion.

The term "distortion" is a function of the frequency-domain transform coefficients in the block or blocks that belong to a group and is a mapping from the space of groups to the space of non-negative real numbers. A distortion of zero is assigned to the frame that contains exactly N groups, where N is the number of blocks in the frame. In this case, there is no sharing of control parameters between or among blocks.

The term "side cost" is a discrete function that maps from the set of non-negative integer numbers to the set of non-negative real numbers. In the following discussion the side cost is assumed to be a positive linear function of the argument x, where x equals $p-1$ and p is the number of groups in a frame. A side cost of zero is assigned to a frame if the number of groups in the frame is equal to one.

Two techniques for computing distortion are described below. One technique computes distortion on a "banded" basis for each of K frequency bands, where each frequency band is a set of one or more contiguous frequency-domain transform coefficients. A second technique computes a single distortion value for the entire block in a wideband sense across all of its frequency bands. It is useful to define several more terms for the following discussion.

The term "banded distortion" is a vector of values of dimension K, indexed from low to high frequency. Each of the K elements in the vector represent a distortion value for a respective set of one or more transform coefficients in a block.

The term "block distortion" is a scalar value that represents a distortion value for a block.

The term "pre-echo distortion" is a scalar value that expresses a level of so-called pre-echo distortion relative to some Just Noticeable Difference (JND) wideband reference energy threshold, where distortion below the JND reference energy threshold is considered unimportant.

The term "time support" is the extent of time-domain samples corresponding to a single block of transform coefficients. For the Modified Discrete Cosine Transform (MDCT) described in Princen et al., "Subband/Transform Coding Using Filter Bank Designs Based on Time Domain Aliasing Cancellation," ICASSP 1987 Conf. Proc., May 1987, pp. 2161-64, any modification to a transform coefficient affects the information that is recovered from two consecutive blocks of transform coefficients due to the 50% overlap of segments in the time domain that is imposed by the transform. The time support for this MDCT is the time segment corresponding only to the first affected block of coefficients.

The term "joint channel coding" is a coding technique by which two or more channels of audio information are combined in some fashion at the encoder and separated into the distinct channels at the decoder. The separate channels obtained by the decoder may not be identical or even perceptually indistinguishable from the original channels. Joint channel coding is used to increase coding efficiency by exploiting mutual information between both channels.

Pre-echo distortion is a consideration with regard to time-domain masking for a transform audio coding system in which the time support of the transform is longer than a pre-masking time interval. Additional information regarding the pre-masking time interval may be obtained from Zwicker et al., "Psychoacoustics—Facts and Models," Springer-Verlag, Berlin 1990. The optimization techniques described below assume that the time support is less than the pre-masking interval and, therefore, only objective measures of distortion are considered.

The present invention does not exclude the option of performing the optimization based on a measurement of subjective or perceptual distortion as opposed to an objective measurement of distortion. In particular, if the time support is larger than the optimal length for a perceptual coder, it is possible that a mean square error or other objective measurement of distortion would not accurately reflect the level of the audible distortion and that the use of a measurement of subjective distortion could select a block grouping configuration that differs from the grouping configuration obtained by using an objective measurement.

The optimization process may be designed in a variety of ways. One way iterates the value p from 1 to N, where p is the number of groups in a frame, and identifies for each value of p the configurations of groups that have a sum of the distortions of all blocks in the frame that is not higher than a threshold T. Among these identified configurations, one of three techniques described below may be used to select the optimum configuration of groups. Alternatively, the value of p may be determined in some other way such as by a two-channel encoding process that optimizes coding gain by adaptively selecting a number of blocks for joint channel coding. In such a case, a common value of p is derived from the individual values of p for each channel. Given a common value of p for the two channels, the optimal group configuration may be computed jointly for both channels.

The group configuration of blocks in a frame may be frequency dependent but this requires that the encoded signal convey additional information to specify how the frequency bands are grouped. Various aspects of the present invention may be applied to multiband implementations by considering bands with common grouping information as separate instantiations of the wideband implementations disclosed herein.

2. Error Energy as Distortion Measure

The meaning of "distortion" has been defined in terms of a quantity that drives the optimization but this distortion has not yet been related to anything that can be used by a process for finding an optimal grouping of blocks in an audio encoder. What is needed is a measure of encoded signal quality that can direct the optimization process toward an optimal solution. Because the optimization is directed toward using a common set of control parameters for each block in a group of blocks, the measure of encoded signal quality should be based on something that applies to each block and can be readily combined into a single representative value or composite measure for all blocks in the group.

One technique for obtaining a composite measure that is discussed below is to compute the mean of some value for the blocks in the group provided a useful mean can be calculated for the value in question. Unfortunately, not all values available in audio coding can be used to compute a useful mean from a plurality of values. One example of an unsuitable value is the Discrete Fourier Transform (DFT) phase component for a transform coefficient because a mean of these phase components does not provide any meaningful value. Another technique for obtaining a composite measure is to select the maximum of some value for all blocks in the group. In either case, the composite measure is used as a reference value and the measure of encoded signal quality is inversely related to the distance between this reference value and the value for each block in a group. In other words, the measure of encoded signal quality for a frame can be defined as the inverse of the error between a reference value and the appropriate value for each block in each group for all groups in the frame.

A measure of encoded signal quality as described above can be used to drive the optimization by performing a process that minimizes this measure.

Other parameters may be relevant in various coding systems or in other applications. One example is the parameters related to so-called mid/side coding, which is a common joint channel coding technique in which the "mid" channel is the sum of the left and right channels and the "side" channel is the difference between the left and right channels. Implementations of coding systems incorporating various aspects of the present invention may use inter-channel correlation instead of energy levels to control the sharing of mid/side coding parameters across blocks. In general, any audio encoder that groups blocks into groups, shares encoding control parameters among the blocks in a group, and transmits the control information to a decoder can benefit from the present invention, which can determine an optimal grouping configuration for the blocks. Without the benefits provided by the present invention, a suboptimal allocation of bits may result in an overall increase in audible quantization distortion because bits are diverted from encoding spectral coefficients and may not be allocated optimally among the various spectral coefficients.

3. Vector Energy Versus Scalar Energy

Implementations of the present invention may use either banded distortion or block distortion values to drive the optimization process. Whether to use banded distortion or block distortion depends to a great extent on the variation in banded energy from one block to the next. Given the following definitions:

$u_m$ is a scalar energy value for total energy in block m, and (1a)

$v_{mj}$ is a vector element representing banded energy for band j in block m, (1b)

if the signal to be encoded is memory less such that $\mu(v_{mj},v_{m+1j})=0$, where $0 \leqq j \leqq K-1$ for K frequency bands and pt is a measure of the degree of mutual information between adjacent blocks then a system that uses the scalar energy measure $u_m$ will work as well as a system that uses banded energy measure values $v_{mj}$. See Jayant et al., "Digital Coding of Waveforms," Prentice-Hall, N.J., 1984. In other words, when successive blocks have little similarity in spectral energy levels, scalar energy works as well as banded energy as a measure. On the other hand, as described below, when successive blocks have a high degree of similarity in spectral energy levels, scalar energy may not provide a satisfactory measure to indicate whether parameters may be common to two or more blocks without imposing serious penalty in encoding performance.

The present invention is not restricted to using any particular measures. Distortion measures based on log-energies and other signal properties may also be appropriate in various applications.

For block transitions that have similar spectral content, or $\mu(v_{mj},v_{m+1j})>0$, it is nonetheless still possible for specific band energy values $v_{mj}$ to satisfy the following expression:

$$\sum_{j=0}^{K-1} v_{m,j} - \sum_{j=0}^{K-1} v_{m+1,j} = 0 \tag{2}$$

or equal to a small value near zero. This result illustrates the fact that, on a wideband basis, a comparison of the overall energy between adjacent blocks may overlook differences between blocks in individual frequency bands. For many signals, a scalar measure of energy is not sufficient to minimize distortion accurately. Because this is true for a wide variety of audio signals, an implementation of the present invention described below uses the vector of banded energy values $V_m=(v_{i,0}, \ldots, v_{i,K-1})$ instead of the scalar block energy value $u_m$ to identify the optimal grouping configuration.

4. Identification of Constraints

There are numerous constraints to be considered based on the application in which the invention is employed. An implementation of the present invention that is described below is an audio coding system; therefore, the relevant constraints are parameters related to the encoding of audio information. For example, a side cost constraint arises from the need to transmit control parameters that are common to all blocks in a group. A higher side cost may allow a signal to be encoded with lower distortion for each block but the increase in side cost may increase total distortion for all blocks in a frame if a fixed number of bits must be allocated to each frame. There may also be constraints imposed on implementation complexity that favor a particular implementation of the present invention over another.

5. Problem Statement Derivation

The following is a numerical problem definition for optimizing distortion in an audio coding system. In this particular problem definition, distortion is a measure of error energy between the spectral coefficients for a frame in a candidate grouping of blocks and the spectral coefficient energy of the individual blocks in a frame where each blocks is in its own group.

Assume an ordered set of N banded energy vectors $V_i$, $0 \leqq i < N$, where each vector is of dimension K with real positive elements, i.e., $V_i = \{v_{i,0}, \ldots, v_{i,K-1}\}$. The symbol $V_i$ represents a vector of banded energy values, where each element of the vector may correspond to essentially any desired band of transform coefficients. For any ordered set of positive integers $0 = s_0 < s_1 < \ldots < s_p = N$, one may define intervals $I_m$ as $I_m = [s_{m-1}, s_m]$, $\forall m$, $0 < m \leqq p$. The symbol $s_m$ represents the block index of the first block in each group and m is the group index. The value $s_p = N$ can be thought of as an index to the first block of the next frame for the sole purpose of defining an endpoint for the interval $I_m$. One may define a partition $P(s_0, \ldots, s_p)$ of the set of energy vectors as follows:

$$P(S) = (G_0, \ldots, G_{p-1}), \tag{3}$$

where S is the vector $(s_0, \ldots, s_p)$ and $$G_m = \{V_i | i \in I_m\}. \tag{4}$$

The symbol $G_m$ is representative of the blocks in a group.

Several distortion measures may be used in various implementations of the present invention. The mean maximum distortion measure M' is defined as follows:

$$J_{m,j} = \max_{i \in G_m} (v_{i,j}) \tag{5}$$

$$J'(m) = \sum_{j=0}^{K-1} \sum_{i \in G_m} (J_{m,j} - v_{i,j}) \tag{6}$$

$$M'(S) = \sum_{m=1}^{p} J'(m) \tag{7}$$

The mean distortion A is defined as follows:

$$K_{m,j} = \frac{1}{(s_m - s_{m-1})} \sum_{i \in G_m} v_{i,j} \tag{8}$$

$$K'(m) = \sum_{j=0}^{K-1} \sum_{i \in G_m} |K_{m,j} - v_{i,j}| \tag{9}$$

$$A(S) = \sum_{m=1}^{p} K'(m) \tag{10}$$

A maximum difference distortion M" is defined as follows:

$$J''(m) = \sum_{j=0}^{K-1} |J_{m,j} - J_{m+1,j}| \tag{11}$$

$$M''(S) = \sum_{m=1}^{p} J''(m) \tag{12}$$

The side cost function for a partition $P(S) = P(s_0, \ldots, s_p)$ is defined to be equal to $(p-1)c$, where c is a positive real constant.

Two additional functions for distortion are defined as follows:

$$M^*(S) = M(S) + \mathrm{Dist}\{(p-1)c\} \tag{13}$$

$$A^*(S) = A(S) + \mathrm{Dist}\{(p-1)c\} \tag{14}$$

where M(S) may be either M'(S) or M"(S), and

Dist{ } is a mapping to express side cost in the same units as distortion.

The function for M(S) may be chosen according to the search algorithm used to find an optimal solution. This is discussed below. The Dist{ } function is used to map side cost into values that are compatible with M(S) and A(S). In some coding systems, a suitable mapping from side cost to distortion is $$\mathrm{Dist}\{C\} = 6.02\ \mathrm{dB} \cdot C$$

where C is the side cost expressed in bits.

The optimization may be formulated as the following numerical problem: determine a vector S with positive integer elements $(s_0, s_1, \ldots, s_p)$ that minimizes a particular distortion function M(S), M*(S), A(S) or A*(S) for all possible choices of positive integers $s_0, s_1, \ldots, s_p$ that satisfy the relation $0 = s_0 < s_1 < \ldots < s_p = N$, where $1 \leqq p \leqq N$. The variable p may be chosen in the range from 1 to N to find the vector S that minimizes the desired distortion function.

Alternatively, the optimization may be formulated as a numerical problem that uses a threshold: Determine for all integer values of p, $1 \leqq p \leqq N$, the vector $S = (s_0, s_1, \ldots, s_p)$ that satisfy the relation $0 = s_0 < s_1 < \ldots < s_p = N$ such that the value of a desired distortion function M(S), M*(S), A(S) or A*(S) is below an assumed threshold value T. From these vectors, find a vector S with the minimal value for p. An alternative to this approach is to iterate over increasing values of p from 1 to N and select the first vector S that satisfies the threshold constraint. This approach is described in more detail below.

6. Additional Considerations for Multi-Channel Systems

For stereo or multi-channel coding systems that employ joint-stereo/multi-channel coding methods such as channel coupling used in AC-3 systems and mid/side stereo coding or intensity stereo coding used in AAC systems, the audio information in all channels should be encoded in the appropriate short block mode for that particular coding system, ensuring that the audio information in all channels have the same number of groups and same grouping configuration. This restriction applies because scale factors, which are the principal source of side cost, are provided only for one of the jointly encoded channels. This implies that all channels have the same grouping configuration because one set of scale factors applies to all channels.

The optimization may be performed in any of at least three ways in multi-channel coding systems: One way referred to as "Joint Channel Optimization" is done by a joint optimization of the number of groups and the group boundaries in a single pass by summing all error energies, either banded or wide-band, across the channels.

Another way referred to as "Nested Loop Channel Optimization" is done by a joint channel optimization implemented as a nested loop process where the outer loop computes the optimal number of groups for all channels. Considering both channels in a joint-stereo coding mode, for example, the inner loop performs an optimization of the ideal grouping configuration for a given number of groups. The principal constraint that is imposed on this approach is that the process performed in the inner loop uses the same value of p for all jointly coded channels.

Yet another way referred to as "Individual Channel Optimization" is done by optimizing the grouping configuration for each channel independently of all other channels. No joint-channel coding technique can be used encode any channel in a frame with unique values of p or a unique grouping configuration.

7. Methods for Performing Constrained Optimization

The present invention may use essentially any desired method for searching for an optimum solution. Three methods are described here.

The "Exhaustive Search Method" is computationally intensive but always finds the optimum solution. One approach calculates the distortion for all possible numbers of groups and all possible grouping configurations for each number of groups; identifies the grouping configuration with the minimum distortion for each number of groups; and then determines the optimal number of groups by selecting the configuration having the minimum distortion. Alternatively, the method can compare the minimum distortion for each number of groups with a threshold and terminate the search after finding the first grouping configuration that has a distortion measure below the threshold. This alternative implementation reduces the computational complexity of the search to find an acceptable solution but it cannot ensure the optimal solution is found.

The "Greedy Merge Method" is not as computationally intensive as the Exhaustive Search Method and cannot ensure the optimum grouping configuration is found but it usually finds a configuration that is either as good as or nearly as good as the optimum configuration. According to this method, adjacent blocks are combined into groups iteratively while accounting for side cost.

The "Fast Optimal Method" has a computational complexity that is intermediate to the complexity of the other two methods described above. This iterative method avoids considering certain group configurations based on distortion calculations that were computed in earlier iterations. Like the Exhaustive Search method, all group configurations are considered but a consideration of some configurations can be eliminated from subsequent iterations in view of prior computations.

8. Parameters that Affect Side Cost

Preferably an implementation of the present invention accounts for changes in side cost as it searches for an optimum grouping configuration.

The principal component in side cost for AAC systems is the information needed to represent scale factor values. Because scale factors are shared across all blocks in a group, the addition of a new group in an AAC encoder will increase the side cost by the amount of additional information needed to represent the additional scale factors. If an implementation of the present invention in an AAC encoder does account for changes in side cost, this consideration must use an estimate because the scale factor values cannot be known until after the rate-distortion loop calculation is completed, which must be performed after the grouping configuration is established. Scale factors in AAC systems are highly variable and their values are tied closely to the quantization resolution of spectral coefficients, which is determined in the nested rate/distortion loops. Scale factors in AAC are also entropy coded, which further contributes to the nondeterministic nature of their side cost.

Other forms of side costs are possible depending on the specific encoding processes used to encode the audio information. In AC-3 systems, for example, channel coupling coordinates may be shared across blocks in a manner that favors grouping the coordinates according to a common energy value.

Various aspects of the present invention are applicable to the process in AC-3 systems that selects the "exponent coding strategy" used to convey transform coefficient exponents in an encoded signal. Because AC-3 exponents are taken as a maximum of power spectral density values for all spectral lines that share a given exponent, the optimization process can operate using a maximum error criterion instead of the mean square error criterion used-in AAC. In an AC-3 system, the side cost is the amount of information needed to convey exponents for each new block that does not reuse exponents from the previous block. The exponent coding strategy, which also determines how coefficients share exponents across frequency, affects the side cost if the exponent strategy is dependent on the grouping configuration. The process needed to estimate the side cost of the exponents in AC-3 systems is less complex than the process needed to provide an estimate for scale factors in AAC systems because the exponent values are computed early in the encoding process as part of the psychoacoustic model.

C. Detailed Descriptions of Search Methods

1. Exhaustive Search Method

Figure 2:
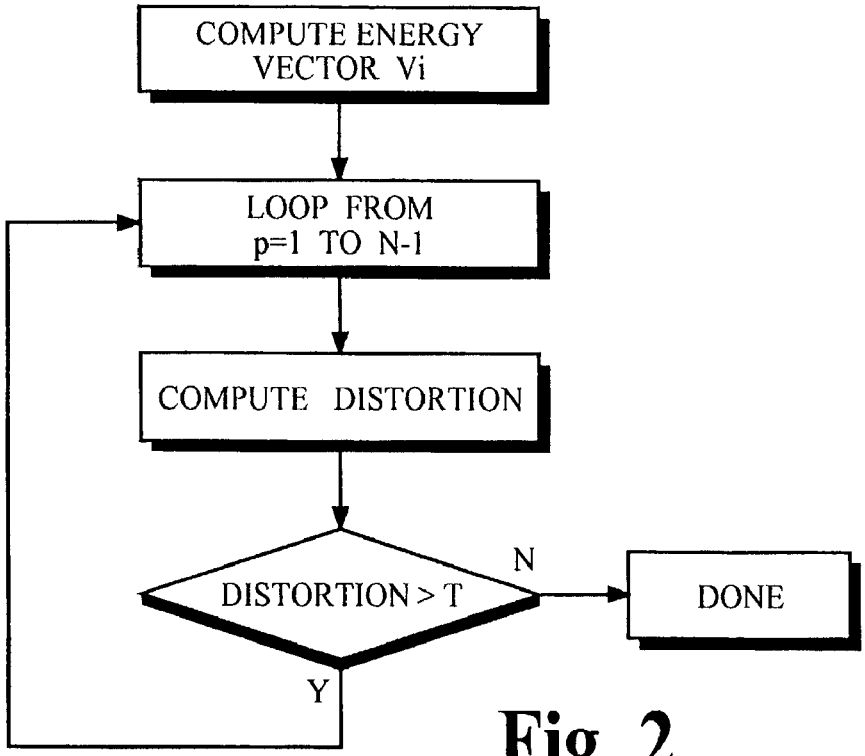
FIG. 2 is a flow chart of an outer loop in an iterative process for finding an optimal number of groups of blocks in a frame.
Figure 3A:
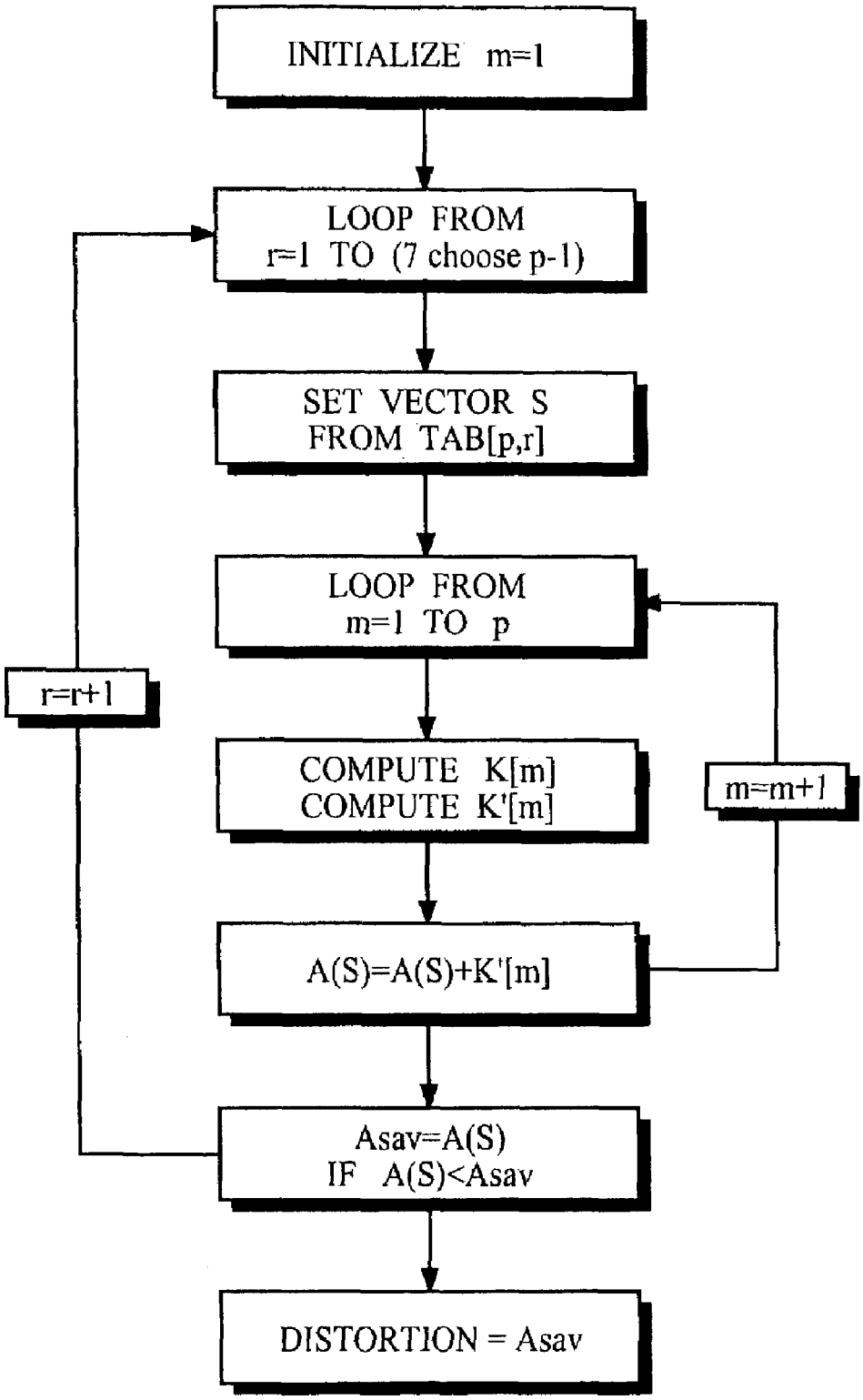
FIGS. 3A and 3B are flow charts of an inner loop in an iterative process for finding an optimal grouping of blocks in a frame.
Figure 3B:
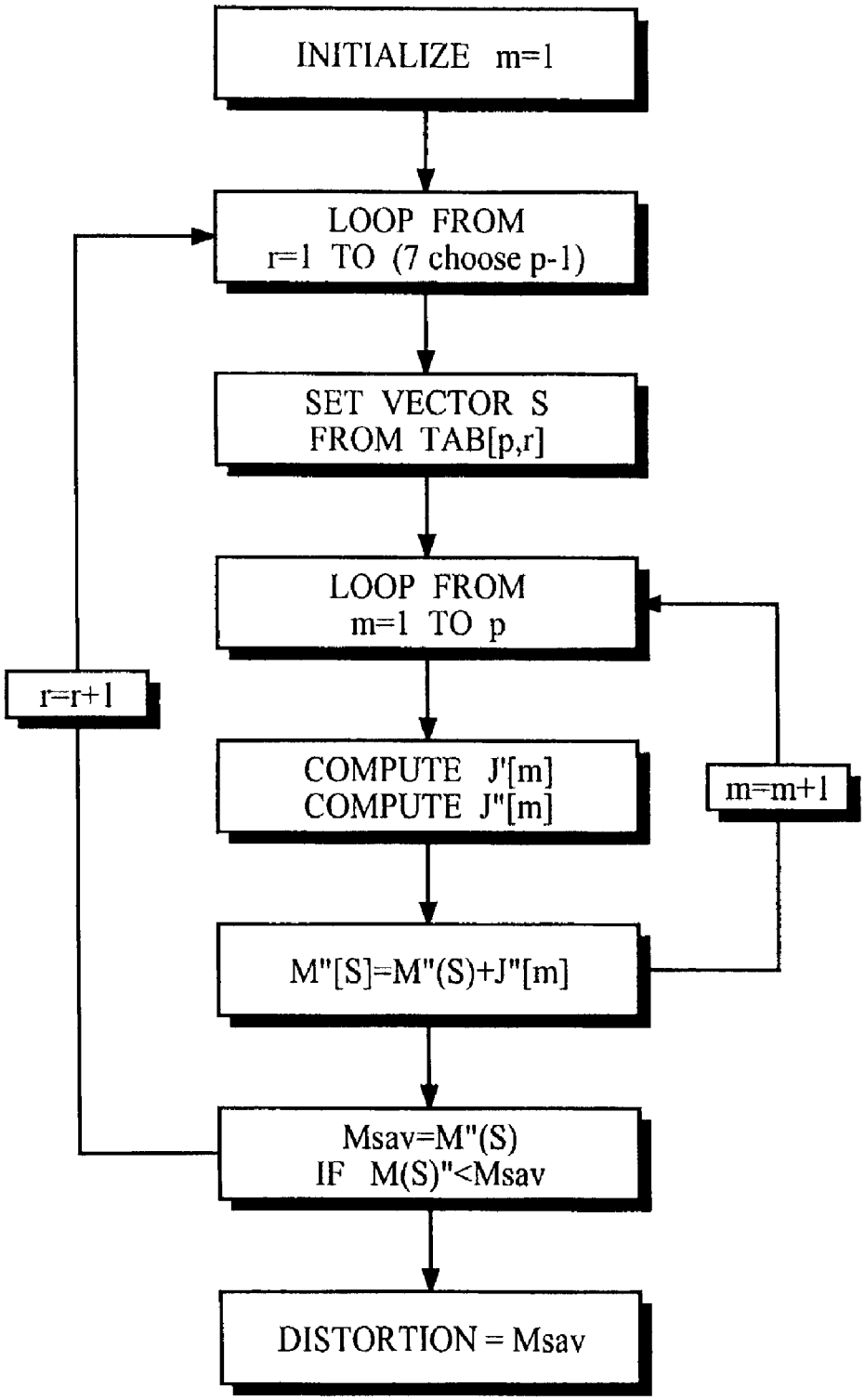

The exhaustive search method may be implemented using a threshold to limit the number of grouping configurations and the number of groups tested. This technique may be simplified by relying exclusively on the threshold value to set the actual value of p. This may be done by setting the threshold value to some number between 0.0 and 1.0 and iterating over the possible number of groups p. The optimal group configuration and resultant distortion function is computed for p=1 and incrementing p by one for each comparison against T. The resulting distortion is compared against T and the first value of p for which the distortion function is less than T is selected as the optimal number of groups. By empirically setting the value of the threshold T, it is possible to achieve a Gaussian distribution of p across a large sampling of short window frames for a wide variety of different input signals. This Gaussian distribution may be shifted by setting the value of T accordingly to allow for a higher or lower average value of p over a wide variety of input signals. This process is shown in the flow chart of FIG. 2, which shows a process in an outer loop for finding an optimal number of groups. Suitable processes for the inner loop are shown in FIGS. 3A and 3B, and are discussed below. Any of the distortion functions described herein may be used including the functions M(S), M*(S), A(S) and A*(S).

For a given value of p, as determined by iterating the outer loop, the inner loop computes the optimal grouping configuration $S=(s_0, s_1, \ldots, s_p)$ that achieves the least amount of mean square error distortion. For small values of N on the order of less than 10, it is possible to build a set of table entries that contains all possible ways of partitioning the p groups across the N blocks. The length of each table entry is the number of combinations of 7 chosen (p−1) at a time, denoted below as "7 choose p−1." There is a separate table entry for all values of p except p=0, which is undefined, and p=N, which yields the distortionless solution where each group contains exactly one block. For 0<p<N, a preferred implementation of the table stores the partition values for $S=\{s_0, s_1, s_p\}$ as bit fields in a table TAB and processing in the inner combinatorial loop masks the TAB bit field values to arrive at the absolute values for each $s_m$. The partition values for the bit fields for 0<p<N are as follows:

TABLE 1

All Possible Combinations of Groupings for N = 8

| Number of group boundaries (p − 1) | Table Length (7 choose p − 1) | $S_1, S_2 \ldots, S_{p-1}$ combinations (in bit field form) |
|---|---|---|
| 1 | 7 | 1, 2, 4, 8, 16, 32, 64 |
| 2 | 21 | 3, 5, 6, 9, 10, 12, 17, 18, 20, 24, 33, 34, 36, 40, 48, 65, 66, 68, 72, 80, 96 |
| 3 | 35 | 7, 11, 13, 14, 19, 21, 22, 25, 26, 28, 35, 37, 38, 41, 42, 44, 49, 50, 52, 56, 67, 69, 70, 73, 74, 76, 81, 82, 84, 88, 97, 98, 100, 104, 112 |
| 4 | 35 | 15, 23, 27, 29, 30, 39, 43, 45, 46, 51, 53, 54, 57, 58, 60, 71, 75, 77, 78, 83, 85, 86, 89, 90, 92, 99, 101, 102, 105, 106, 108, 113, 114, 116, 120 |
| 5 | 21 | 31, 47, 55, 59, 61, 62, 79, 87, 91, 93, 94, 103, 107, 109, 110, 115, 117, 118, 121, 122, 124 |
| 6 | 7 | 63, 95, 111, 119, 123, 125, 126 |
| 7 | 1 | 127 |

Each entry or row in the table corresponds to a different value of p, for 0<p<N, N=8. This table may be used in an iterative process such as the ones shown in the logic flow diagrams of FIGS. 3A and 3B, which is the inner loop of the process shown in FIG. 2. This inner loop iterates over all possible group configurations, which are (7 choose p−1) in number. As shown by the notation TAB[p,r] in the flow diagrams, the p value provided by the outer loop indexes the row of the table and the value r indexes the bit field for a particular grouping combination.

For each inner loop iteration, the mean distortion measure A(S) as shown in FIG. 3A or, alternatively, the maximum difference distortion M"(S) as shown in FIG. 3B is computed according to equations 10 or 12, respectively. The total distortion across all blocks and bands is summed to obtain a single scalar value $A_{sav}$ or, alternatively, $M_{sav}$.

The Exhaustive Search Method may use a variety of distortion measures. For example, the implementation discussed above uses an L1 Norm but L2 Norm or L Infinity Norm measures may be used instead. See R. M. Gray, A. Buzo, A. H. Gray, Jr., "Distortion Measures for Speech Processing," IEEE *Transactions on Acoustics, Speech, and Signal Processing*, Vol. ASSP-28, No. 4, August 1980.

2. Fast Optimal Method

The fast optimal method uses the mean maximum distortion M'(S) defined above in equation 7. This method obtains an optimum grouping configuration without having to exhaustively search through all possible solutions. As a result, it is not as computationally intensive as the exhaustive search method described above.

a) Definitions

A partition $P(s_0, \ldots, s_p)$ is said to be a partition of level p if it consists of p groups. The dimension d of a group is the number of blocks in that group. Groups with a dimension greater than 1 are referred to as positive groups. The definition of a group $G_m$ as expressed in equation 4 is rewritten as $G_m=G(s_{m-1}, s_{m-1}+1 \ldots, s_m)$.

b) Mathematical Preliminaries

A group that has a dimension d>3 may be split into two subgroups that have exactly one block in common. For example, if $G_m=G(s_{m-1}, s_{m-1}+1 \ldots, s_m)$, then the group $G_m$ may be split into two subgroups $G_{ma}=G(s_{m-1}, s_{m-1}+1, \ldots, s_{m-1}+k)$ and $G_{mb}=G(s_{m-1}+k, \ldots, s_m)$, which both contain the block having the index $s_{m-1}+k$. By definition, these two subgroups cannot be part of the same partition. A procedure for splitting a group into two positive overlapping subgroups can be generalized into a procedure that splits a given group into two or more positive overlapping subgroups.

The distortion measure J'(m) defined above in equation 6 always satisfies the following assertion:

$$J'(m) \geqq J'(ma)+J'(mb) \tag{15}$$

where $G_{ma}$ and $G_{mb}$ are overlapping subgroups of group $G_m$. This can be proven by showing that $J_{m,j} \geqq \max(J_{ma,j}, J_{mb,j})$ is true for all j, $1 \leqq j \leqq k$. By inserting this relation into the definition of J'(m) as shown in equation 6, it may be seen that the assertion in expression 15 follows.

c) Core Process Description

The principles underlying the fast optimal method may be understood by first assuming a given partition $P_p$ of level p that minimizes $M'(S)=M'(s_1, \ldots, s_p)$ for all vectors $s_1, \ldots, s_p$ that define a partition of level p There are partitions F of level p−1 that, independent of the specific values of the spectral coefficients, cannot be the unique partition $P_{p-1}$ of level p−1 that minimizes $M'(s_1, \ldots, s_p)$ for all vectors $S=(s_1, \ldots, s_p)$ that define a partition of level p−1. In other words, if one of these partitions F minimizes M'(S) for all vectors S that define a partition of level p−1 then there exists at least one other partition that minimizes M"(S) for all vectors S that define a partition of level p−1 as well. One may define a subset of these partitions F, denoted as X(p,P), which contains particular partitions at level p that can be excluded from some of the processing needed to find an optimal solution as described in more detail below. The subset X(p,P) is defined as follows:

(1) Assume a partition F of level p−1 has n positive groups and that m, 0<m<n, positive groups of this partition, respectively, may be replaced by another positive group of the same dimension and that after the replacement, the partition F is transformed into a partition G of level p−1 having no overlapping groups. If the positive groups of partition P are a subset of the positive groups of partition G but not of partition F, then F belongs to X(p,P).

(2) Assume a partition F of level p−1 has n positive groups and that m, 0<m≦n, positive groups of F can be split into two or more positive groups. Assume further that one or more of these positive groups can be replaced by a group with the same dimension and to transform the partition F into a valid partition G of level p−1 having no overlapping groups. If the positive groups of partition P are a subset of the positive groups of partition G but not of the partition F, then according to the assertion made in 15, F belongs to X(p,P).

It may be helpful to point out that, by construction, the set X(p,P) cannot be identical to the set of all partitions of level p−1.

d) Generalized Case (N Arbitrary)

The fast optimal method begins by partitioning the N blocks of a frame into p=N groups and calculates the mean maximum distortion function M'(S) or M*(S). This partition is denoted as $P_N$. The method then calculates the mean maximum distortion function for all N−1 possible ways of partitioning the N blocks into g=N−1 groups. The particular partition out of the these N−1 partitions that minimizes the mean maximum distortion function is denoted as $P_{N-1}$. Partitions that belong to the set $X(N-1,P_{N-1})$ are identified as described above. The method then calculates the mean maximum distortion function for all possible ways of partitioning the N blocks into N−1 groups that do not belong to the set $X(N-1, P_{N-1})$. The partition that minimizes the mean maximum distortion function is denoted $P_{N-2}$. The fast optimal method iterates this process for p=N−2, . . . , 1 to find partitions $P_{p-1}$, using the set $X(p,P_p)$ at each level to reduce the number of partitions that are analyzed as a possible solution.

The fast optimal method concludes by finding the partition P among the partitions $P_1, \ldots, P_N$ that minimizes the mean maximum distortion function M'(S) or M*(S).

e) EXAMPLE

The following example is provided to help explain the fast optimal method and to set forth features of a possible implementation. In this example, each frame contains six blocks or N=6. A set of control tables may be used to simplify the processing required to determine whether a partition should be added to the set $X(p,P_p)$ as described above. A set of tables, Tables 2A through 2C, are shown for this example.

The notation D(a,b) is used in these tables to identify specific partitions. A partition consists of one or more groups of blocks and can be uniquely specified by the positive groups it contains. For example, a six-block partition that consists of four groups in which the first group contains blocks 1 and 2, the second group contains blocks 3 and 4, the third group contains block 5 and the fourth group contains block 6, may be expressed as (1,2) (3,4) (5) (6) and is shown in the tables as D(1,2)+D(3,4).

Each table provides information that may be used to determine whether a particular partition at level p−1 belongs to the set $X(p,P_p)$ when processing a particular partition $P_p$ at level p. Table 2A, for example, provides information for determining whether a partition at level 4 belongs to the set $X(5,P_5)$ for each level 5 partition shown in the upper row of the table. The upper row of Table 2A, for example, lists partitions that consist of five groups. Not all partitions are listed. In this example, all of the partitions that include five groups are D(1,2), 1)(2,3), D(3,4), D(4,5) and D(5,6). Only partitions D(1,2), D(2,3) and D(3,4) are shown in the upper row of the table. The missing partitions D(4,5) and D(5,6) are symmetric to partitions D(2,3) and D(1,2), respectively, and can be derived from them. The left column in Table 2A shows partitions that consist of four groups. The symbols "Y" and "N" shown in each table indicate whether ("Y") or not ("N") the partition at level p−1 shown in the left-band column should be excluded from further processing for the respective partition $P_p$ shown in the upper row of the table in that column. Referring to Table 2A, for example, the level 5 partition D(1,2) has an "N" entry in the row for the level 4 partition D(2,3,4), which indicates partition D(2,3,4) belongs to the set X(5,D(1,2)) and should be excluded from further processing. The level 5 partition D(2,3) has a "Y" entry in the row for the level 4 partition D(2,3,4), which indicates that level 4 partition does not belong to the set X(5,D(2,3)).

In this example, a process that implements the fast optimal method partitions the six blocks of a frame into six groups and calculates the mean maximum distortion. The partition is denoted as $P_6$.

The process calculates the mean maximum distortion for all five possible ways of partitioning the six blocks into 5 five groups. The partition out of the five partitions that minimizes the mean maximum distortion is denoted as $P_5$.

The process refers to Table 2A and selects the column whose top entry specifies the grouping configuration of partition $P_5$. The process calculates the mean maximum distortion for all possible ways of partitioning the six blocks into four groups that have a "Y" entry in the selected column. The partition that minimizes the mean maximum distortion is denoted $P_4$.

The process uses Table 2B and selects the column whose top entry specifies the grouping configuration of partition $P_4$. The process calculates the mean maximum distortion for all possible ways of partitioning the six blocks into three groups that have a "Y" entry in the selected column. The partition that minimizes the mean maximum distortion is denoted $P_3$.

The process uses Table 2C and selects the column whose top entry specified the grouping configuration of partition $P_3$. The process calculates the mean maximum distortion for all possible ways of partitioning the six blocks into groups that have a "Y" entry in the selected column. The partition that minimizes the mean maximum distortion is denoted $P_2$.

The process calculates the mean maximum distortion for the partition that consists of one group. This partition is denoted as $P_1$.

The process identifies the partition P among the partitions P1, . . . , P6 that has the smallest mean maximum distortion. This partition P provides the optimal grouping configuration.

TABLE 2A

Fast Optimal Group Elimination Table for p = 5

| p = 5 | D(1, 2) | D(2, 3) | D(3, 4) |
|---|---|---|---|
| D(1, 2) + D(3, 4) | Y | Y | Y |
| D(1, 2) + D(4, 5) | Y | N | N |
| D(1, 2) + D(5, 6) | Y | N | N |

TABLE 2A-continued

| Fast Optimal Group Elimination Table for p = 5 | | | |
|---|---|---|---|
| p = 5 | D(1, 2) | D(2, 3) | D(3, 4) |
| D(2, 3) + D(4, 5) | N | Y | Y |
| D(2, 3) + D(5, 6) | N | Y | N |
| D(3, 4) + D(5, 6) | N | N | Y |
| D(1, 2, 3) | Y | Y | N |
| D(2, 3, 4) | N | Y | Y |
| D(3, 4, 5) | N | N | Y |
| D(4, 5, 6) | N | N | N |

TABLE 2B

| Fast Optimal Group Elimination Table for p = 4 | | | | | | |
|---|---|---|---|---|---|---|
| p = 4 | D(1, 2) + D(3, 4) | D(1, 2) + D(4, 5) | D(1, 2) + D(5, 6) | D(2, 3) + D(4, 5) | D(1, 2, 3) | D(2, 3, 4) |
| D(3, 4, 5, 6) | Y | Y | Y | Y | N | N |
| D(2, 3) + D(4, 5, 6) | N | Y | Y | Y | Y | Y |
| D(2, 3, 4) + D(5, 6) | Y | Y | N | Y | N | Y |
| D(2, 3, 4, 5) | Y | Y | N | Y | N | Y |
| D(1, 2) + D(4, 5, 6) | N | Y | Y | Y | Y | Y |
| D(1, 2) + D(3, 4) + D(5, 6) | Y | Y | Y | Y | Y | Y |
| D(1, 2) + D(3, 4, 5) | Y | Y | N | Y | Y | Y |
| D(1, 2, 3) + D(5, 6) | Y | Y | Y | Y | Y | N |
| D(1, 2, 3, 4) | Y | Y | N | Y | Y | Y |
| D(1, 2, 3) + D(4, 5) | Y | Y | Y | Y | Y | Y |

TABLE 2C

| Fast Optimal Group Elimination Table for p = 3 | | | | | | |
|---|---|---|---|---|---|---|
| p = 3 | D(1, 2, 3, 4) | D(2, 3, 4, 5) | D(1, 2) + D(3, 4, 5) | D(1, 2) + D(4, 5, 6) | D(2, 3) + D(4, 5, 6) | D(1, 2) + D(3, 4) + D(5, 6) |
| D(1, 2, 3, 4, 5) | Y | Y | Y | Y | Y | Y |
| D(1, 2, 3, 4) + D(5, 6) | Y | Y | Y | Y | Y | Y |
| D(1, 2, 3) + D(4, 5, 6) | Y | Y | Y | Y | Y | Y |
| D(1, 2) + D(3, 4, 5, 6) | Y | Y | Y | Y | Y | Y |
| D(2, 3, 4, 5, 6) | N | Y | Y | Y | Y | Y |

3. Greedy Merge Description

The greedy merge method provides a simplified technique for partitioning the blocks in a frame into groups. While the greedy merge method does not guarantee that the optimal grouping configuration will be found, the reduction in computational complexity provided by this method may be more desirable than a possible reduction in optimality for most practical applications.

The greedy merge method may use a wide variety of the distortion measure functions including those discussed above. A preferred implementation uses the function shown in expression 11.

Figure 4:
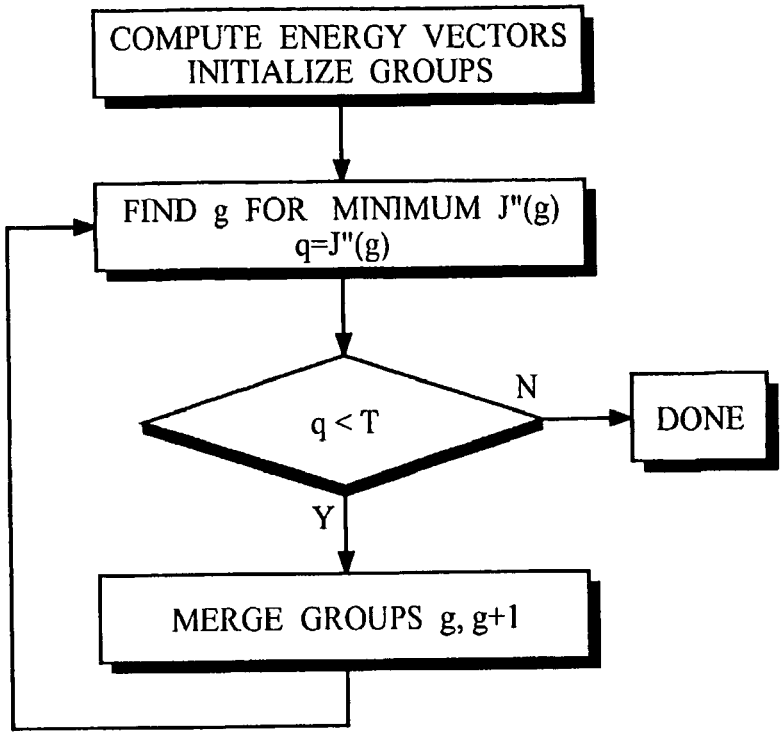
FIG. 4 is flow chart of a Greedy Merge process.

FIG. 4 shows a flow diagram of a suitable greedy merge method that operates as follows: the banded energy vectors $V_i$ are calculated for each block i. A set of N groups are created with each having one block. The method then tests all N−1 adjacent pairs of the groups and finds the two adjacent groups g and g+1 that minimize equation 11. The minimum value of J" from equation 11 is denoted q. The minimum value q is then compared to a distortion threshold T. If the minimum value is greater than the threshold T, the method terminates with the current grouping configuration identified as the optimum or near-optimum configuration. If the minimum value is less than the threshold T, the two groups g and g+1 are merged into a new group containing the banded energy vectors of the of the two groups g and g+1. This method iterates until the distortion measure J" for all pairs of adjacent groups exceeds the distortion threshold T or until all blocks have been merged into one group.

Figure 5:
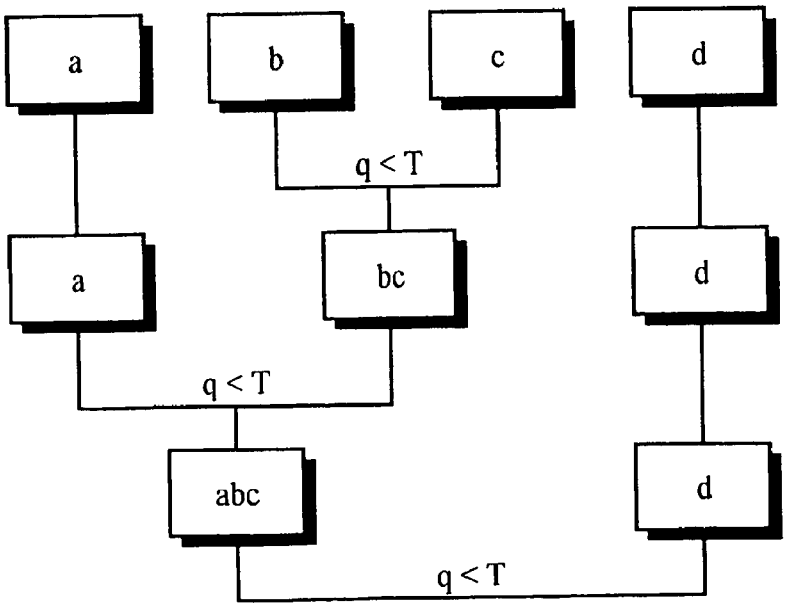
FIG. 5 is a conceptual block diagram that illustrates an example of a Greedy Merge process applied to four blocks.

An example of the way this method operates with a frame of four blocks is shown in FIG. 5. In this example, the four blocks are initially arranged into four groups a, b, c and d having one block each. The method then finds the two adjacent groups that minimize equation 11. In the first iteration, the method finds groups b and c minimize equation 11 with a distortion measure J" that is less than the distortion threshold T; therefore, the method merges groups b and c into a new group to obtain three groups a, bc, and d. In the second iteration, the method finds the two adjacent groups a and be minimize equation 11 and the distortion measure J" for this pair of groups is less than the threshold T. Groups a and bc are merged into a new group to give a total of two groups abc and d. In the third iteration, the method finds the distortion measure J" for the only remaining pair of groups is greater than distortion threshold T; therefore, the method terminates leaving the final two groups abc and d as the optimal or near-optimal grouping configuration.

The actual order of computational complexity for the greedy merge method depends on the number of times the method must iterate before the threshold is exceeded; however, the number of iterations is bounded between 1 and ½ N·(N−1).

D. Implementation

Figure 6:
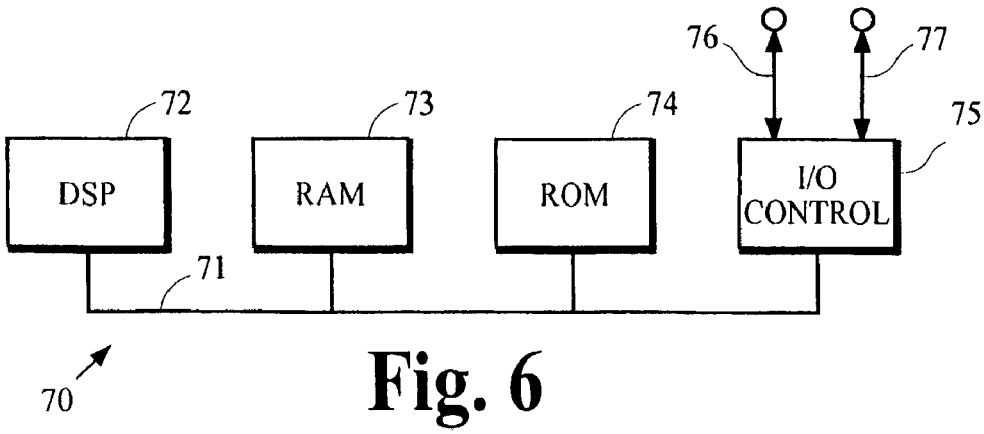
FIG. 6 is a schematic block diagram of a device that may be used to implement various aspects of the present invention.

Devices that incorporate various aspects of the present invention may be implemented in a variety of ways including software for execution by a computer or some other device that includes more specialized components such as digital signal processor (DSP) circuitry coupled to components similar to those found in a general-purpose computer. FIG. 6 is a schematic block diagram of a device 70 that may be used to implement aspects of the present invention. The DSP 72 provides computing resources. RAM 73 is system random access memory (RAM) used by the DSP 72 for processing. ROM 74 represents some form of persistent storage such as read only memory (ROM) for storing programs needed to operate the device 70 and possibly for carrying out various aspects of the present invention. I/O control 75 represents interface circuitry to receive and transmit signals by way of the communication channels 76, 77. In the embodiment shown, all major system components connect to the bus 71, which may represent more than one physical or logical bus; however, a bus architecture is not required to implement the present invention.

In embodiments implemented by a general purpose computer system, additional components may be included for interfacing to devices such as a keyboard or mouse and a display, and for controlling a storage device having a storage medium such as magnetic tape or disk, or an optical medium. The storage medium may be used to record programs of instructions for operating systems, utilities and applications, and may include programs that implement various aspects of the present invention.

The functions required to practice various aspects of the present invention can be performed by components that are implemented in a wide variety of ways including discrete logic components, integrated circuits, one or more ASICs and/or program-controlled processors. The manner in which these components are implemented is not important to the present invention.

Software implementations of the present invention may be conveyed by a variety of machine readable media such as baseband or modulated communication paths throughout the spectrum including from supersonic to ultraviolet frequencies, or storage media that convey information using essentially any recording technology including magnetic tape, cards or disk, optical cards or disc, and detectable markings on media including paper.

The invention claimed is:

1. A method for processing blocks of audio information arranged in frames, each block having content representing a respective time interval of audio information, wherein the method comprises:

(a) receiving an input signal conveying the blocks of audio information;

(b) obtaining two or more measures of quality such that:

(1) each set in a plurality of sets of groups of the blocks in a respective frame has an associated measure of quality, (2) each group has one or more blocks, (3) each set of groups includes all blocks in the respective frame and no block is included in more than one group in each set, and (4) the measure of quality represents excellence in results obtainable by processing each block in a respective group according to one or more control parameters associated with the respective group;

(c) analyzing the measures of quality to identify a selected set of groups having a minimum number of groups such that a measure of processing performance obtained at least in part from the associated measure of quality is higher than a threshold; and (d) processing each group of blocks in the selected set of groups according to the associated one or more control parameters to generate an output signal representing contents of the input signal and representing the associated control parameters for each group in the selected set.

2. The method of claim 1 wherein the blocks comprise time-domain samples of audio information.

3. The method of claim 1 wherein the blocks comprise frequency-domain coefficients of audio information.

4. The method of claim 1 wherein at least one pair of blocks in the groups having more than one block have content representing audio information in time intervals that are adjacent to one another or overlap one another.

5. The method of claim 1 that comprises:

obtaining two or more measures of cost, each measure of cost affiliated with a set of groups of blocks, wherein the measure of cost represents an amount of resources needed to process the blocks in the affiliated set according to the associated of control parameters;

wherein the measure of processing performance is obtained in part from the measure of cost affiliated with the selected set.

6. The method of claim 5 wherein the measures of cost are responsive to amounts of data needed to represent the control parameters in the encoded signal.

7. The method of claim 5 wherein the measures of cost are responsive to amounts of computational resources needed to process the blocks of audio information.

8. The method of claim 1 wherein the analyzing is performed in one or more iterations of an iterative process to determine one or more sets of groups that are not candidates for the selected set and excludes analyzing these one or more sets in subsequent iterations of the process.

9. The method of claim 1 wherein the selected set is identified by an iterative process that comprises:

determining a second measure of processing performance for pairs of groups in an initial set of groups;

merging the pair of groups having a highest second measure of processing performance to form a revised set of groups provided that the highest second measure of processing performance is greater than a threshold, and determining the second measure of processing performance for pairs of groups in the revised set of groups; and continuing the merging until no pair of groups in the revised set of groups has a second measure of processing performance that is greater than the threshold, wherein the revised set of groups is the selected set.

10. The method of claim 1 wherein a respective frame has a number of blocks equal to N and the analyzing of the measures of quality comprises:

iterating a value p from 1 to N, where p is the number of groups of blocks in a frame;

identifying for each value of p at least some of the sets of groups that have the measure of processing performance that is higher than the threshold; and analyzing at least some of the identified sets of groups to determine the selected set of groups that maximizes the measure of processing performance among the sets of groups that are analyzed.

11. The method of claim 1 wherein each block in the respective frame comprises spectral coefficients and the measure of processing performance for a particular set of groups represents a measure of error energy between the spectral coefficients in the respective frame for the particular set of groups and the spectral coefficients in the respective frame with each block in its own group.

12. The method of claim 1 wherein the measure of processing performance is responsive to a total number of bits available to represent a respective frame of blocks.

13. An apparatus for processing blocks of audio information arranged in frames, each block having content representing a respective time interval of audio information, wherein the method comprises:

means for receiving an input signal conveying the blocks of audio information;

means for obtaining two or more measures of quality such that:

(1) each set in a plurality of sets of groups of the blocks in a respective frame has an associated measure of quality, (2) each group has one or more blocks, (3) each set of groups includes all blocks in the respective frame and no block is included in more than one group in each set, and (4) the measure of quality represents excellence in results obtainable by processing each block in a respective group according to one or more control parameters associated with the respective group;

means for analyzing the measures of quality to identify a selected set of groups having a minimum number of groups such that a measure of processing performance obtained at least in part from the associated measure of quality is higher than a threshold; and means for processing each group of blocks in the selected set of groups according to the associated one or more control parameters to generate an output signal representing contents of the input signal and representing the associated control parameters for each group in the selected set.

14. The apparatus of claim 13 wherein the blocks comprise time-domain samples of audio information.

15. The apparatus of claim 13 wherein the blocks comprise frequency-domain coefficients of audio information.

16. The apparatus of claim 13 wherein at least one pair of blocks in the groups having more than one block have content representing audio information in time intervals that are adjacent to one another or overlap one another.

17. The apparatus of claim 13 that comprises:

means for obtaining two or more measures of cost, each measure of cost affiliated with a set of groups of blocks, wherein the measure of cost represents an amount of resources needed to process the blocks in the affiliated set according to the associated control parameters;

wherein the measure of processing performance is obtained in part from the measure of cost affiliated with the selected set.

18. The apparatus of claim 17 wherein the measures of cost are responsive to amounts of data needed to represent the control parameters in the encoded signal.

19. The apparatus of claim 17 wherein the measures of cost are responsive to amounts of computational resources needed to process the blocks of audio information.

20. The apparatus of claim 13 wherein the means for analyzing iteratively analyzes to determine one or more sets of groups that are not candidates for the selected set and excludes analyzing these one or more sets in subsequent iterations.

21. The apparatus of claim 13 wherein the means for analyzing performs its analysis by:

determining a second measure of processing performance for pairs of groups in an initial set of groups;

merging the pair of groups having a highest second measure of processing performance to form a revised set of groups provided that the highest second measure of processing performance is greater than a threshold, and determining the second measure of processing performance for pairs of groups in the revised set of groups; and continuing the merging until no pair of groups in the revised set of groups has a second measure of processing performance that is greater than the threshold, wherein the revised set of groups is the selected set.

22. The apparatus of claim 13 wherein a respective frame has a number of blocks equal to N and the analyzing of the measures of quality comprises:

iterating a value p from 1 to N, where p is the number of groups of blocks in a frame;

identifying for each value of p at least some of the sets of groups that have the measure of processing performance that is higher than the threshold; and analyzing at least some of the identified sets of groups to determine the selected set of groups that maximizes the measure of processing performance among the sets of groups that are analyzed.

23. The apparatus of claim 13 wherein each block in the respective frame comprises spectral coefficients and the measure of processing performance for a particular set of groups represents a measure of error energy between the spectral coefficients in the respective frame for the particular set of groups and the spectral coefficients in the respective frame with each block in its own group.

24. The apparatus of claim 13 wherein the measure of processing performance is responsive to a total number of bits available to represent a respective frame of blocks.

25. A computer-readable storage medium recording a program of instructions that is executable by a device to perform a method for processing blocks of audio information arranged in frames, each block having content representing a respective time interval of audio information, wherein the method comprises:

(a) receiving an input signal conveying the blocks of audio information;

(b) obtaining two or more measures of quality such that:

(1) each set in a plurality of sets of groups of the blocks in a respective frame has an associated measure of quality, (2) each group has one or more blocks, (3) each set of groups includes all blocks in the respective frame and no block is included in more than one group in each set, and (4) the measure of quality represents excellence in results obtainable by processing each block in a respective group according to one or more control parameters associated with the respective group;

(c) analyzing the measures of quality to identify a selected set of groups having a minimum number of groups such that a measure of processing performance obtained at least in part from the associated measure of quality is higher than a threshold; and (d) processing each group of blocks in the selected set of groups according to the associated one or more control parameters to generate an output signal representing contents of the input signal and representing the associated control parameters for each group in the selected set.

26. The medium of claim 25 wherein the blocks comprise time-domain samples of audio information.

27. The medium of claim 25 wherein the blocks comprise frequency-domain coefficients of audio information.

28. The medium of claim 25 wherein at least one pair of blocks in the groups having more than one block have content representing audio information in time intervals that are adjacent to one another or overlap one another.

29. The medium of claim 25 wherein the method comprises:

obtaining two or more measures of cost, each measure of cost affiliated with a set of groups of blocks, wherein the measure of cost represents an amount of resources needed to process the blocks in the affiliated set according to the associated control parameters;

wherein the measure of processing performance is obtained in part from the measure of cost affiliated with the selected set.

30. The medium of claim 29 wherein the measures of cost are responsive to amounts of data needed to represent the control parameters in the encoded signal.

31. The medium of claim 29 wherein the measures of cost are responsive to amounts of computational resources needed to process the blocks of audio information.

32. The medium of claim 25 wherein the analyzing is performed in one or more iterations of an iterative process to determine one or more sets of groups that are not candidates for the selected set and excludes analyzing these one or more sets in subsequent iterations of the process.

33. The medium of claim 25 wherein the selected set is identified by an iterative process that comprises:

determining a second measure of processing performance for pairs of groups in an initial set of groups;

merging the pair of groups having a highest second measure of processing performance to form a revised set of groups provided that the highest second measure of processing performance is greater than a threshold, and determining the second measure of processing performance for pairs of groups in the revised set of groups; and continuing the merging until no pair of groups in the revised set of groups has a second measure of processing performance that is greater than the threshold, wherein the revised set of groups is the selected set.

34. The medium of claim 25 wherein a respective frame has a number of blocks equal to N and the analyzing of the measures of quality comprises:

iterating a value p from 1 to N, where p is the number of groups of blocks in a frame;

identifying for each value of p at least some of the sets of groups that have the measure of processing performance that is higher than the threshold; and analyzing at least some of the identified sets of groups to determine the selected set of groups that maximizes the measure of processing performance among the sets of groups that are analyzed.

35. The medium of claim 25 wherein each block in the respective frame comprises spectral coefficients and the measure of processing performance for a particular set of groups represents a measure of error energy between the spectral coefficients in the respective frame for the particular set of groups and the spectral coefficients in the respective frame with each block in its own group.

36. The medium claim 25 wherein the measure of processing performance is responsive to a total number of bits available to represent a respective frame of blocks.

* * * * *